United States Patent [19]

Kanai et al.

[11] Patent Number: 4,527,146

[45] Date of Patent: Jul. 2, 1985

[54] VARISTOR

[75] Inventors: Hideyuki Kanai, Kawasaki; Osamu Furukawa, Sagamihara; Motomasa Imai; Takashi Takahashi, both of Tokyo, all of Japan

[73] Assignee: Tokyo Shibaura Denki Kabushiki Kaisha, Kawasaki, Japan

[21] Appl. No.: 564,100

[22] Filed: Dec. 22, 1983

[30] Foreign Application Priority Data

Dec. 24, 1982 [JP] Japan ..... 57-226207
Sep. 30, 1983 [JP] Japan ..... 58-180171

[51] Int. Cl.[3] ..... H01C 7/10

[52] U.S. Cl. ..... 338/20; 338/21; 252/518

[58] Field of Search ..... 338/21, 20; 252/518-521

[56] References Cited

U.S. PATENT DOCUMENTS

| | | | |
|---|---|---|---|
| 4,041,436 | 7/1977 | Kouchich et al. | 338/21 |
| 4,042,535 | 7/1977 | May | 252/518 |
| 4,045,374 | 7/1977 | Nagasawa et al. | 252/518 X |
| 4,046,847 | 9/1977 | Kresge | 338/21 X |
| 4,111,852 | 9/1978 | Ho et al. | 252/518 |
| 4,147,670 | 4/1979 | Shohata et al. | 252/518 X |
| 4,165,351 | 8/1979 | May | 264/66 |
| 4,374,049 | 2/1983 | Ellis et al. | 252/518 X |
| 4,386,021 | 5/1983 | Kazuo et al. | 252/519 |
| 4,397,775 | 7/1983 | Levinson | 252/519 X |
| 4,450,426 | 6/1984 | Miyoshi et al. | 338/21 |

FOREIGN PATENT DOCUMENTS

| | | |
|---|---|---|
| 2842287 | 3/1980 | Fed. Rep. of Germany . |
| 46-19472 | 5/1971 | Japan . |
| 49-119188 | 11/1974 | Japan . |
| 56-3645 | 1/1981 | Japan . |

OTHER PUBLICATIONS

English Abstract of Japanese Kokai No. 52-54994, (5--4-1977).

English Abstract of Japanese Kokai No. 52-136388, (11-15-1977).

Chemical Abstracts: vol. 87, 1977, p. 581, No. 61556d.

*Primary Examiner*—Roy N. Envall, Jr.
*Assistant Examiner*—C. N. Sears
*Attorney, Agent, or Firm*—Schwartz, Jeffery, Schwaab, Mack, Blumenthal & Evans

[57] ABSTRACT

A varistor comprising a basic component consisting essentially of ZnO as a principal constituent and, as auxiliary components, bismuth (Bi), cobalt (Co), manganese (Mn), antimony (Sb) and nickel (Ni) in an amount, when calculated in terms of $Bi_2O_3$, $Co_2O_3$, MnO, $Sb_2O_3$ and NiO, respectively, of $Bi_2O_3$: 0.1 to 5 mol %, $Co_2O_3$: 0.1 to 5 mol %, MnO: 0.1 to 5 mol %, $Sb^2O_3$: 0.1 to 5 mol % and NiO: 0.1 to 5 mol %; and an additional constituent comprising boron (B) in an amount, when calculated in terms of $B_2O_3$, of 0.001 to 1 wt % based on said basic component, the $Bi_2O_3$ of the sintered body comprising not less than 30% of $\alpha$-phase . In another embodiment, the above basic component may further comprise at least one of Al, In and Ga in a prescribed amount and the above additional component may be (i) B with or without at least one of Ag and Si in a prescribed amount or (ii) a glass containing B in a prescribed amount.

12 Claims, 8 Drawing Figures

VARISTOR

BACKGROUND OF THE INVENTION

This invention relates to a varistor comprising a sintered body containing a zinc oxide (ZnO) as a principal component. Particularly, it relates to a varistor having excellent life performance when a direct current is applied.

Various kinds of varistors (i.e., voltage-current non-linear resistors) for which extensive researches have been made include a varistor made of a sintered body containing ZnO as a principal component. In the case of such a varistor, it has been attempted to secure the desired performances by adding various kinds of auxiliary components.

Recently, researches and developments have been made on the direct current transmission, which, different from the alternating current transmission, impose very severe conditions upon the varistor because the electric field is applied to the non-linear resistor always in a single direction. Under the existing state of the art, however, there has been no varistor having a direct current life performance excellent enough to be useful under such severe conditions. For instance, known varistors are those comprising ZnO added with $Bi_2O_3$, CoO, $Sb_2O_3$, NiO and MnO as disclosed in Unexamined Patent Publication (KOKAI) No. 119188/1974, those comprising ZnO added with B and Bi as disclosed in Patent Publication (KOKOKU) No. 19472/1971 and those comprising ZnO added with a glass containing a boron oxide as disclosed in Patent Publication (KOKOKU) No. 33842/1981, etc., every of which, however, does not secure sufficient performance; for instance, they are poor in the life performance since the leakage current at the application of the direct current increases with lapse of time and the thermal runaway is caused thereby.

Moreover, demands for the performances such as the voltage-current non-linearity and the life performance have recently become severer as the ultra-high voltage (UHV) power transmission has made progress.

Thus, demands for improvements of the performances such as the life performance and the non-linearity have become larger year by year, and researches have been made everywhere in order to fulfill such demands.

This invention, made on account of the foregoing, has the object of providing a varistor having excellent direct current life performance. It is also an object of the present invention to provide a varistor having excellent voltage-current non-linearity. It is another object of the present invention to provide a varistor comprising a sintered body which contains a specific amount of $\alpha$-phase $Bi_2O_3$, but which is substantially free of chromium.

SUMMARY OF THE INVENTION

According to this invention, there is provided a varistor made of a sintered body comprising:

a basic component comprising a zinc oxide (ZnO) as a principal component and, as auxiliary components, bismuth (Bi), cobalt (Co), manganese (Mn), antimony (Sb) and nickel (Ni) in an amount, when calculated in terms of $Bi_2O_3$, $Co_2O_3$, MnO, $Sb_2O_3$ and NiO, respectively, of $Bi_2O_3$: 0.1 to 5 mol %, $Co_2O_3$: 0.1 to 5 mol %, MnO: 0.1 to 5 mol %, $Sb_2O_3$: 0.1 to 5 mol % and NiO: 0.1 to 5 mol %; and an additional component comprising boron (B) in an amount, when calculated in terms of $B_2O_3$, of 0.001 to 1 wt % based on said basic component.

In another embodiment of this invention, the above basic component may further comprise at least one of aluminum (Al), indium (In) and gallium (Ga) in a prescribed amount and the above additional component may be (i) boron (B) with or without further addition of at least one of silver (Ag) and silicon (Si) in a prescribed amount or (ii) a glass containing boron (B) in a prescribed amount.

This invention will be described below in detail with reference to the accompanying drawings.

DESCRIPTION OF PREFERRED EMBODIMENTS OF THE INVENTION

Figure 1:
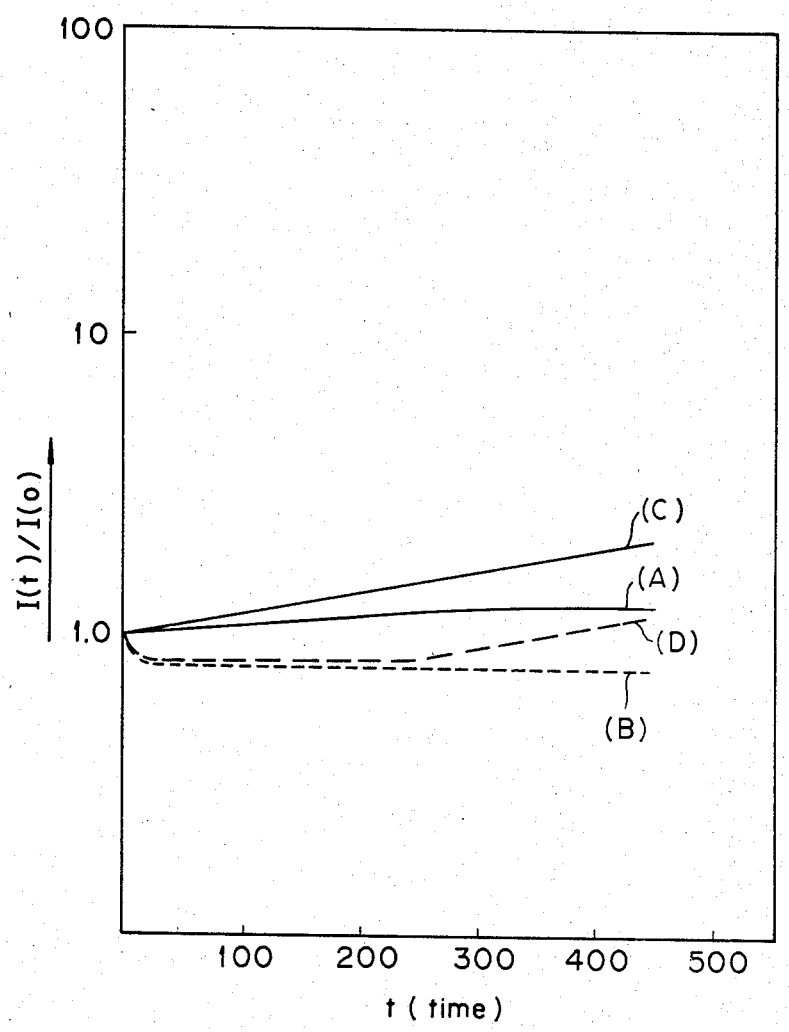
FIGS. 1, 2, 3 and 5 each show performance curves of varistors.

A first embodiment of this invention is a varistor made of a sintered body comprising;

a basic component comprising a zinc oxide (ZnO) as a principal component and, as auxiliary components, bismuth (Bi), cobalt (Co), manganese (Mn), antimony (Sb) and nickel (Ni) in an amount, when calculated in terms of $Bi_2O_3$, $Co_2O_3$, MnO, $Sb_2O_3$ and NiO, respectively, of $Bi_2O_3$: 0.1 to 5 mol %, $Co_2O_3$: 0.1 to 5 mol %, MnO: 0.1 to 5 mol %, $Sb_2O_3$: 0.1 to 5 mol % and NiO: 0.1 to 5 mol %; and an additional component comprising boron (B) in an amount, when calculated in terms of $B_2O_3$, of 0.001 to 1 wt % based on said basic component.

By assuming the composition comprising $Bi_2O_3$, $Co_2O_3$, MnO, $Sb_2O_3$ and NiO to which B has been added as in the above, the direct current life performance is improved remarkably. Also, the life performance at the application of an alternating current and the non-linearity as well are particularly excellent.

The reason why the content of each of $Bi_2O_3$, $Co_2O_3$, MnO, $Sb_2O_3$ and NiO is defined in this embodiment to range from 0.1 to 5 mol % is that the non-linearity and the life performance become deteriorated if it ranges otherwise. The performances are improved by adding B to the above basic components. In particular, the direct current life performance is dramatically improved. More specifically speaking, when only the basic components are present, the leakage current increases with lapse of time in the application of a direct current, causing the thermal runaway, thereby making it impossible to use a varistor for the direct current transmission, but, by the addition of B in an amount, calculated in terms of $B_2O_3$, of 0.001 to 1 wt %, the direct current life performance is improved because of a small increase in the leakage current with lapse of time. If the amount is less than 0.001 wt %, no effect of the addition of B will be present; the direct current life performance is particularly improved by the addition thereof in an amount of 0.001 wt % or more. If it exceeds 1 wt %, not only the direct current life performance but also the alternating current life performance and the non-linearity will become deteriorated on the contrary.

The content of each of the above components are expressed in terms of a calculated value, and therefore they may be added in the form of every kind of carbonates, etc. For instance, the boron may be added in various kinds of forms such as $B_2O_3$, $H_3BO_3$, $HBO_2$, $B_2(OH)_4$, $ZnB_4O_7$, $AgBO_2$, ammonium borate, $Ag_2B_4O_7$, $BaB_4O_7$, $Mg(BO_2)_2.8H_2O$, $MnB_4O_7.8H_2O$, $BiBO_3$, $Ni_3(BO_3)_2$, $Ni_2B_2O_5$, etc.

Taking account of homogeneous mixing of the raw materials, it is preferred that the boron component takes the form readily soluble in water and is mixed as an aqueous solution. As the boron readily soluble in water, there may be mentioned, for example, $H_3BO_3$, $HBO_2$, $B_2(OH)_4$, $ZnB_4O_7$, ammonium borate, $AgBO_2$, $Ag_2B_4O_7$, etc.

According to a second embodiment of this invention, the non-linearity can be still improved by the further addition of at least one of Al, In and Ga to the basic component. In this embodiment, the additional component may comprise B with or without further addition of at least one of Ag and Si.

Namely, the second embodiment is a varistor made of a sintered body comprising:

a basic component comprising a zinc oxide (ZnO) as a principal component and, as auxiliary components, bismuth (Bi), cobalt (Co), manganese (Mn), antimony (Sb) and nickel (Ni) in an amount, when calculated in terms of $Bi_2O_3$, $Co_2O_3$, MnO,$Sb_2O_3$ and NiO, respectively, of $Bi_2O_3$: 0.1 to 5 mol %, $Co_2O_3$: 0.1 to 5 ml %, MnO: 0.1 to 5 mol %, $Sb_2O_3$: 0.1 to 5 mol % and NiO: 0.1 to 5 mol %; and further at least one selected from the group consisting of aluminum (Al), indium (In) and gallaium (Ga) in an amount, when calculated in terms of $Al^{3+}$, $In^{3+}$ and $Ga^{3+}$, respectively, of from 0.0001 to 0.05 mol %; and the above additional component comprising the boron (B) only.

In this embodiment, the additional component may further comprise at least one selected from the group consisting silver (Ag) and silicon (Si) in an amount, when calculated in terms of $Ag_2O$ and $SiO_2$, of from 0.002 to 0.2 wt % and 0.001 to 0.1 wt %, respectively, based on said basic component.

The addition of $Al^{3+}$, $In^{3+}$ and $Ga^{3+}$ becomes effective when added in the amount of not more than 0.05 mol %. The $Al^{3+}$ et al may be added in a trace amount to produce effective results, and, in particular, in an amount of not less than 0.0001 mol % to give excellent effects. When they are added too much, the performances become deteriorated on the contrary. The addition of $Al^{3+}$ et al produces great effects particularly to the improvement of the non-linearity. Since the effect in the improvement in performances can be achieved by the addition thereof in a very small amount as mentioned above, it is also preferred that they are mixed or added in the form of an aqueous solution of a water soluble compound such as a nitrate.

The content of $Ag_2O$ and $SiO_2$ is defined in this invention to range from 0.002 to 0.2 wt % and 0.001 to 0.1 wt %, respectively. This is becase the improvement of the life performance is hardly effective and even the non-linearity becomes deteriorated on the contrary when it exceeds the above range. The $Ag_2O$ and $SiO_2$ each may be added solely in order to be effective in improving the life performance, but can be added in combination of the both of them in order to be more effective.

The content of $B_2O_3$ when added in combination with $Ag_2O$ and/or $SiO_2$ should preferably range from 0.002 to 0.2 wt % basded on the basic component.

In a third embodiment of this invention, a glass containing a prescribed amount of boron (B) may be used as the additional component mentioned in the above second embodiment. Namely, the third embodiment is a varistor made of a sintered body comprising;

a basic component comprising a zinc oxide (ZnO) as a principal component and, as auxiliary components, bismuth (Bi), cobalt (Co), manganese (Mn), antimony (Sb) and nickel (Ni) in an amount, when calculated in terms of $Bi_2O_3$, $Co_2O_3$, MnO, $Sb_2O_3$ and NiO, respectively, of $Bi_2O_3$: 0.1 to 5 mol %, $Co_2O_3$: 0.1 to 5 mol %, MnO: 0.1 to 5 mol %, $Sb_2O_3$: 0.1 to 5 mol % and NiO: 0.1 to 5 mol %; and further at least one selected from the group consisting of aluminum (Al), indium (In) and gallium (Ga) in an amount, when calculated in terms of $Al^{3+}$, $In^{3+}$ and $Ga^{3+}$, respectively, of from 0.0001 to 0.05 mol %; and an additional component comprising a glass containing boron (B) in an amount, when calculated in terms of $B_2O_3$, of from 0.001 to 1 wt % based on said basic component.

The same effects as in the second embodiment of this invention can be obtained by adding the B-containing glass to the above-mentioned basic component comprising $Bi_2O_3$, $Co_2O_3$, MnO, $Sb_2O_3$, NiO, and at least one of Al, In and Ga. To be added is a glass containing B in an amount, when calculated in terms of $B_2O_3$, of from 0.001 to 1 wt %, whereby the direct current life performance is also improved because of a small increase in the leakage current with lapse of time. If the amount is less than 0.001 wt %, no effect of the addition of the B-containing glass will be present; the direct current life performance is particularly improved by the addition thereof in an amount of 0.001 wt % or more. If it exceeds 1 wt %, not only the direct current life performance but also the alternating current life performance and the non-linearity will become deteriorated on the contrary.

Even when the basic component contains no $Al^{3+}$, $In^{3+}$, and/or $Ga^{3+}$, the life performance can be improved to a certain extent by the addition of B or B-containing glass, but in such a case, the non-linearity becomes deteriorated and moreover the capacity of energy dissipation is seriously lowered.

When a varistor is used for a device such as a lightening arrester, designed for the purpose of absorbing a large surge, it is required for it to have good capability of energy dissipation. In general, in order to represent the energy dissipation capability of a varistor by a definite value, employed is the energy dissipation capability per unit volume when a rectangular current wave of 2 ms is applied. JEC(Standard of the Japanese Electrotechnical Committee)-203, page 43, for example, discloses a typical test method therefor.

When the energy dissipation capability is small, flashover or puncture is caused by the application of a large current impulse to a resistor, resulting in no achievement of the object of absorbing the surge and further resulting in remarkable lowering of the performances of the arrester and the like. The energy dissipation capability becomes smaller in the varistor of a system containing no $Al^{3+}$, $In^{3+}$, and/or $Ga^{3+}$.

Crystal structure has been examined with respect to the $Bi_2O_3$ contained in the varistor according to this invention. As a result, the $\alpha$-phase (orthorhombic lattice) was found to have been formed. Proportion of the $\alpha$-phase in the total $Bi_2O_3$ is variable depending on the production conditions such as temperature and composition. Thus, the variation of performances depending on the proportion of the α-phase was examined. As a result, it was found that the direct current life performance becomes especially excellent when the amount of the α-phase in the total amount of the $Bi_2O_3$ exceeds 10%, and more preferably, 30%. It was also found that the energy dissipation capacity becomes stable in a desired value when the α-phase exceeds 50%. This tendency was present when the composition was selected within the scope of this invention. It was the case also in the system where the $Al^{3+}$, $In^{3+}$ and/or $Ga^{3+}$ were contained additionally. However, the α-phase was not formed when the basic components were comprised differently. For instance, the α-phase was not formed when the $B_2O_3$ was added to and contained in a $ZnO—Bi_2O_3—Co_2O_3—MnO—NiO—Sb_2O_3$ system to which added were $Cr_2O_3$ and $SiO_2$; besides, both the non-linearity and the life performance were not improved.

Meanwhile, the α-phase tends to be transformed to the other phase by means of a heat treatment. Accordingly, it is preferred that a step involving such a heating that may cause the transformation of the crystal phase is not applied.

As described above, it is possible according to this invention to produce a varistor having excellent direct current life performance. The varistor according to this invention is excellent in the non-linearity and the alternating current life performance, too.

Accordingly, the varistor of this invention is useful in a lighting arrester as a surge absorber for the direct current high voltage transmission. It is also usefull for an alternating current transmission. It is particularly suitable for use in UHV power transmission. Moreover, it brings about great advantages in the production thereof, such as reduction of production cost and the like, because both the varistors for the direct current and the alternating current can be produced on the same assembly line. It is also useful as an element for electronic equipments of private use as it is excellent in every performance.

This invention will be described in greater detail by the following Examples.

EXAMPLE 1

Mixed with ZnO were $Bi_2O_3$, $Co_2O_3$, MnO, $Sb_2O_3$, NiO in the desired compositional proportions, to which added was an aqueous solution in which $H_3BO_3$ as a compound containing B was dissolved in the desired proportion. After mixing of these, PVA was added as a binder to effect the granulation, and then disk-like compact bodies were formed. Each of these bodies was dried and thereafter sintered at 1100° to 1300° C. for about 2 hours and, further, both surfaces thereof were polished to form a sintered body having diameter of 20 mm and thickness of 2 mm.

On both sides of each of the samples thus formed a pair of electrodes were formed by means of spraying of fused Al to make varistors having the composition shown in Table 1, and performances thereof were examined. Results are shown in Table 1. Also shown in the Table 1 are comparative examples for the varistors having the composition outside this invention. In Table 1, the voltage-current non-linearity is indicated in terms of $V_{2\,kA}/V_{1\,mA}$ and the life performance in terms of $L_{400}$. The content of B is indicated in parts by weight based on the basic components and calculated in terms of $B_2O_3$.

$$V_{2kA}/V_{1mA} = \frac{\text{V(voltage when a current of 2 kA flows)}}{\text{V(voltage when a current of 1 mA flows)}}$$

$$L_{400} = \frac{I\,(400)}{I\,(0)}$$

I(400) designates, while a sorrounding temperature is maintained at 90° C., a leakage current measured at a room temperature after continuous application of a voltage of $0.75 \times V_{1\,mA}$ for 400 hours in the case of D.C., or a leakage current measured at a room temperature after continuous application of a voltage of $0.85 \times V_{1\,mA}$ in the case of A.C. I(0) designates an initial value, and $L_{400}$ indicates the ratio of I (400) and I (0). Mark X in the Table indicates that the thermal runaway took place in 400 hours.

TABLE 1

| Sample No. | ZnO (mol %) | $Bi_2O_3$ (mol %) | $Co_2O_3$ (mol %) | MnO (mol %) | $Sb_2O_3$ (mol %) | NiO (mol %) | $B_2O_3$ (wt %) | $V_{2kA}/V_{1mA}$ | A.C $L_{400}$ | D.C $L_{400}$ |
|---|---|---|---|---|---|---|---|---|---|---|
| Examples: | | | | | | | | | | |
| 1 | Balance | 0.1 | 0.5 | 0.5 | 0.5 | 0.5 | 0.05 | 2.19 | 0.19 | 1.52 |
| 2 | " | 3.0 | " | " | " | " | " | 2.15 | 0.80 | 1.31 |
| 3 | " | 5.0 | " | " | " | " | " | 2.18 | 0.95 | 1.56 |
| 4 | " | 0.5 | 0.1 | " | " | " | " | 2.18 | 0.92 | 1.53 |
| 5 | " | " | 3.0 | " | " | " | " | 2.15 | 0.81 | 1.31 |
| 6 | " | " | 5.0 | " | " | " | " | 2.18 | 0.93 | 1.54 |
| 7 | " | " | 0.5 | 0.1 | " | " | " | 2.19 | 0.94 | 1.55 |
| 8 | " | " | " | 3.0 | " | " | " | 2.16 | 0.81 | 1.31 |
| 9 | " | " | " | 5.0 | " | " | " | 2.18 | 0.92 | 1.53 |
| 10 | " | " | " | 0.5 | 0.1 | " | " | 2.22 | 0.93 | 1.57 |
| 11 | " | " | " | " | 3.0 | " | " | 2.15 | 0.80 | 1.30 |
| 12 | " | " | " | " | 5.0 | " | " | 2.18 | 0.95 | 1.59 |
| 13 | " | " | " | " | 0.5 | 0.1 | " | 2.23 | 0.90 | 1.55 |
| 14 | " | " | " | " | " | 3.0 | " | 2.15 | 0.81 | 1.31 |
| 15 | " | " | " | " | " | 5.0 | " | 2.20 | 0.96 | 1.59 |
| 16 | " | " | " | " | " | 0.5 | 0.001 | 2.15 | 0.91 | 1.58 |
| 17 | " | " | " | " | " | " | 0.01 | 2.15 | 0.80 | 1.31 |
| 18 | " | " | " | " | " | " | 0.1 | 2.15 | 0.80 | 1.31 |
| 19 | " | " | " | " | " | " | 1.0 | 2.17 | 0.88 | 1.50 |
| Comparative examples: | | | | | | | | | | |
| 20 | Balance | 0.05 | 0.5 | 0.5 | 0.5 | 0.5 | 0.05 | 2.55 | X | X |
| 21 | " | 7.0 | " | " | " | " | " | 2.59 | X | X |
| 22 | " | 0.5 | 0.05 | " | " | " | " | 2.47 | X | X |

TABLE 1-continued

| Sample No. | ZnO (mol %) | $Bi_2O_3$ (mol %) | $Co_2O_3$ (mol %) | MnO (mol %) | $Sb_2O_3$ (mol %) | NiO (mol %) | $B_2O_3$ (wt %) | $V_{2kA}/V_{1mA}$ | A.C $L_{400}$ | D.C $L_{400}$ |
|---|---|---|---|---|---|---|---|---|---|---|
| 23 | " | " | 7.0 | " | " | " | " | 2.50 | X | X |
| 24 | " | " | 0.5 | 0.05 | " | " | " | 2.53 | X | X |
| 25 | " | " | " | 7.0 | " | " | " | 2.47 | X | X |
| 26 | " | " | " | 0.5 | 0.05 | " | " | 2.63 | X | X |
| 27 | " | " | " | " | 7.0 | " | " | 2.55 | X | X |
| 28 | " | " | " | " | 0.5 | 0.05 | " | 2.63 | X | X |
| 29 | " | " | " | " | " | 7.0 | " | 2.57 | X | X |
| 30 | " | " | " | " | " | 0.5 | 0.0005 | 2.15 | 1.05 | X |
| 31 | " | " | " | " | " | " | 20.0 | 2.58 | X | X |

As is apparent from Table 1, it is noted that the examples of this invention show superior performances, in particular, have excellent life performance. As will be seen from the comparative examples (Sample Nos. 20 to 29), the effect of the addition of B is not achieved when the basic components have the composition outside this invention and both the direct current life performance and the alternating current life performance become extremely inferior. Also, as will be seen from another comparative example (Sample No. 30), the effect of the addition of B is not present when it is added in a too small amount and the thermal runaway takes place at the application of the alternating current. When it is added in a too large amount (Sample No. 31), every performance becomes deteriorated on the contrary.

Further, changes in the leakage current as time lapses were examined with respect to a varistor having the composition of Sample No. 17. The changes in the leakage current as time lapses is indicated by I(t)/I(0). Measurements were carried out in the same manner as in the measurements of the foregoing I(400)/I(0). Results are shown in FIG. 1, wherein the solid line (A) indicates the case where D.C. was applied and the dotted line (B) the case where A.C. was applied.

As is apparent from FIG. 1, it is noted that the I(t-)/I(o) shows substantially constant value in the case of A.C. application and, in the case of D.C. application, it is saturated after lapse of about 300 hours, showing excellent performance. Thus the life performance is very excellent because of little changes in the leakage current.

For comparison, data in the cases where the boron was added in the form of glass are also shown together in FIG. 1. Namely, the cases where a bismuth borosilicate glass was added and the boron content to the whole was controlled to that similar to Sample No. 17; the solid line (C) designates the direct current life performance and the dotted line (D) the alternating current life performance.

As is apparent from FIG. 1, the leakage current increases with lapse of time in the case of direct current and there is found a tendency that the thermal runaway may takes place with further lapse of time. In the case of alternating current, there is shown a tendency that the leakage current increases after lapse of about 300 hours.

Thus, it is noted that the performances become superior by adding B in the form other than the glass. When it is added in the form of glass, the performances are considered to be inversely affected because of the contents of components other than the boron being in excessive amounts.

As explained in the foregoing, it is possible according to this invention to obtain a varistor which is excellent, in particular, in the direct current life performance. It is also excellent in the non-linearity and the alternating current life performance.

EXAMPLE 2

Examples where $Al^{3+}$ was added will be given in the following: ZnO, $Bi_2O_3$, $CO_2O_3$, MnO, $Sb_2O_3$, NiO, $Al(NO_3)_3$ $9H_2O$ and a compound containing B were mixed and varistors having the composition shown in Table 2 were produced in the same procedures as in Example 1. Performances thereof were also examined to obtain the results shown in Table 2.

TABLE 2

| Sample No. | ZnO (mol %) | $Bi_2O_3$ (mol %) | $Co_2O_3$ (mol %) | MnO (mol %) | $Sb_2O_3$ (mol %) | NiO (mol %) | $Al^{3+}$ (mol %) | $B_2O_3$ Compound | $B_2O_3$ (wt %) | $V_{2kA}/V_{1mA}$ | A.C $L_{400}$ | D.C $L_{400}$ |
|---|---|---|---|---|---|---|---|---|---|---|---|---|
| Example: | | | | | | | | | | | | |
| 32 | Balance | 0.5 | 0.5 | 0.5 | 0.5 | 0.5 | 0.01 | $B_2O_3$ | 0.001 | 1.90 | 0.91 | 1.58 |
| 33 | " | " | " | " | " | " | " | " | 0.01 | 1.90 | 0.80 | 1.31 |
| 34 | " | " | " | " | " | " | " | " | 0.1 | 1.90 | 0.80 | 1.31 |
| 35 | " | " | " | " | " | " | " | " | 1.0 | 1.92 | 0.88 | 1.50 |
| Comparative examples: | | | | | | | | | | | | |
| 36 | " | " | " | " | " | " | " | " | 0.0005 | 1.90 | 1.05 | X |
| 37 | " | " | " | " | " | " | " | " | 20.0 | 2.35 | X | X |
| Examples: | | | | | | | | | | | | |
| 38 | " | " | " | " | 1.0 | 1.0 | " | $ZnB_4O_7$ | 0.001 | 1.90 | 0.90 | 1.57 |
| 39 | " | " | " | " | " | " | " | " | 0.01 | 1.90 | 0.80 | 1.32 |
| 40 | " | " | " | " | " | " | " | " | 0.1 | 1.90 | 0.81 | 1.32 |
| 41 | " | " | " | " | " | " | " | " | 1.0 | 1.92 | 0.87 | 1.51 |
| Comparative examples: | | | | | | | | | | | | |
| 42 | " | " | " | " | " | " | " | " | 0.0005 | 1.90 | 1.10 | X |
| 43 | " | " | " | " | " | " | " | " | 20.0 | 2.30 | X | X |
| Exam- | | | | | | | | | | | | |

TABLE 2-continued

| Sample No. | ZnO (mol %) | $Bi_2O_3$ (mol %) | $Co_2O_3$ (mol %) | MnO (mol %) | $Sb_2O_3$ (mol %) | NiO (mol %) | $Al^{3+}$ (mol %) | $B_2O_3$ Compound | $B_2O_3$ (wt %) | $V_{2kA}/V_{1mA}$ | A.C $L_{400}$ | D.C $L_{400}$ |
|---|---|---|---|---|---|---|---|---|---|---|---|---|
| ples: | | | | | | | | | | | | |
| 44 | " | " | " | 1.0 | " | " | " | $AgBO_2$ | 0.001 | 1.91 | 0.89 | 1.57 |
| 45 | " | " | " | " | " | " | " | " | 0.01 | 1.91 | 0.80 | 1.32 |
| 46 | " | " | " | " | " | " | " | " | 0.1 | 1.91 | 0.80 | 1.31 |
| 47 | " | " | " | " | " | " | " | " | 1.0 | 1.93 | 0.87 | 1.50 |
| Comparative examples: | | | | | | | | | | | | |
| 48 | " | " | " | " | " | " | " | " | 0.0005 | 1.91 | 1.05 | X |
| 49 | " | " | " | " | " | " | " | " | 20.0 | 2.45 | X | X |
| Examples: | | | | | | | | | | | | |
| 50 | " | " | 1.0 | 0.5 | " | 0.5 | " | $BaB_4O_7$ | 0.001 | 1.92 | 0.90 | 1.57 |
| 51 | " | " | " | " | " | " | " | " | 0.01 | 1.92 | 0.81 | 1.31 |
| 52 | " | " | " | " | " | " | " | " | 0.1 | 1.92 | 0.81 | 1.31 |
| 53 | " | " | " | " | " | " | " | " | 1.0 | 1.94 | 0.88 | 1.50 |
| Comparative examples: | | | | | | | | | | | | |
| 54 | " | " | " | " | " | " | " | " | 0.0005 | 1.92 | 1.05 | X |
| 55 | " | " | " | " | " | " | " | " | 20.0 | 2.38 | X | X |
| Examples: | | | | | | | | | | | | |
| 56 | " | 1.0 | 0.5 | " | 1.5 | 1.0 | " | $MnB_4O_7.8H_2O$ | 0.001 | 1.91 | 1.91 | 1.56 |
| 57 | " | " | " | " | " | " | " | " | 0.01 | 1.91 | 0.82 | 1.32 |
| 58 | " | " | " | " | " | " | " | " | 0.1 | 1.91 | 0.82 | 1.32 |
| 59 | " | " | " | " | " | " | " | " | 1.0 | 1.93 | 0.89 | 1.51 |
| Comparative examples: | | | | | | | | | | | | |
| 60 | " | " | " | " | " | " | " | " | 0.0005 | 1.91 | 1.07 | X |
| 61 | " | " | " | " | " | " | " | " | 20.0 | 2.45 | X | X |
| Example: | | | | | | | | | | | | |
| 62 | " | 0.5 | " | " | 0.5 | 0.5 | " | $H_3BO_3$ | 0.001 | 1.89 | 0.87 | 1.50 |
| 63 | " | " | " | " | " | " | " | " | 0.01 | 1.89 | 0.79 | 1.29 |
| 64 | " | " | " | " | " | " | " | " | 0.1 | 1.89 | 0.79 | 1.29 |
| 65 | " | " | " | " | " | " | " | " | 1.0 | 1.90 | 0.87 | 1.49 |
| Comparative examples: | | | | | | | | | | | | |
| 66 | " | " | " | " | " | " | " | " | 0.0005 | 1.89 | 1.05 | X |
| 67 | " | " | " | " | " | " | " | " | 20.0 | 2.35 | X | X |
| Examples: | | | | | | | | | | | | |
| 68 | " | " | " | " | 1.0 | 1.0 | " | $HBO_2$ | 0.01 | 1.90 | 0.80 | 1.30 |
| 69 | " | " | " | " | " | " | " | " | 0.1 | 1.90 | 0.80 | 1.30 |
| 70 | " | " | " | " | " | " | " | $B_2(OH)_4$ | 0.01 | 1.90 | 0.81 | 1.31 |
| 71 | " | " | " | " | " | " | " | " | 0.1 | 1.90 | 0.81 | 1.31 |
| 72 | " | " | " | " | " | " | " | $Ag_2B_4O_7$ | 0.01 | 1.92 | 0.80 | 1.30 |
| 73 | " | " | " | " | " | " | " | " | 0.1 | 1.92 | 0.80 | 1.30 |
| 74 | " | " | " | " | " | " | " | $Hg(BO_2)_2.8H_2O$ | 0.01 | 1.90 | 0.82 | 1.32 |
| 75 | " | " | " | " | " | " | " | " | 0.1 | 1.90 | 0.82 | 1.32 |
| 76 | " | " | " | " | " | " | " | $Ni_3(BO_3)_2$ | 0.01 | 1.90 | 0.82 | 1.31 |
| 77 | " | " | " | " | " | " | 0.01 | " | 0.1 | 1.90 | 0.80 | 1.31 |
| 78 | " | " | " | " | " | " | " | $Ni_2B_2O_5$ | 0.01 | 1.90 | 0.81 | 1.32 |
| 79 | " | " | " | " | " | " | " | " | 0.1 | 1.90 | 0.81 | 1.32 |
| Comparative examples: | | | | | | | | | | | | |
| 80 | " | 0.05 | " | " | " | " | " | $B_2O_3$ | 0.05 | 2.28 | X | X |
| 81 | " | 7.0 | " | " | 0.5 | 0.5 | " | " | " | 2.35 | X | X |
| 82 | " | 0.5 | 0.05 | " | " | " | " | " | " | 2.27 | X | X |
| 83 | " | " | 7.0 | " | " | " | " | " | " | 2.28 | X | X |
| 84 | " | " | 0.5 | 0.05 | " | " | " | " | " | 2.29 | X | X |
| 85 | " | " | " | 7.0 | " | " | " | " | " | 2.31 | X | X |
| 86 | " | " | " | 0.5 | 0.05 | " | " | " | " | 2.36 | X | X |
| 87 | " | " | " | " | 7.0 | " | " | " | " | 2.38 | X | X |
| 88 | " | " | " | " | 0.5 | 0.05 | " | " | " | 2.32 | X | X |
| 89 | " | " | " | " | " | 7.0 | " | " | " | 2.30 | X | X |

As is apparent from Table 2, the non-linearity is improved by adding $Al^{3+}$ to the system, as compared with the cases shown in Table 1. Also in the $Al^{3+}$-containing system, the thermal runaway takes place when the content of B is too small, as in the cases shown in Table 1. When it is too large, every life performance and the non-linearity as well become also deteriorated.

When compared numerically, the improvement in the non-linearity may appear to be small, but, in practical use, the numerically small improvement produces a great effect.

Figure 2:
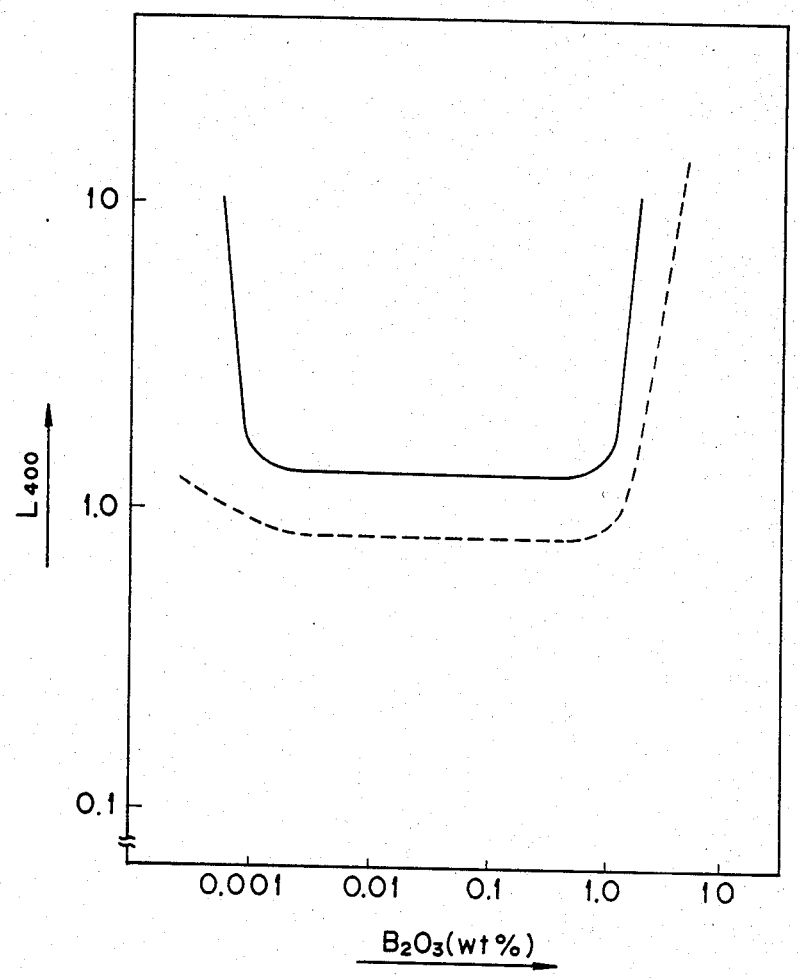

Further, shown in FIG. 2 are changes in the life performances (where solid line: D.C., dotted line: A.C.) when the $B_2O_3$ contents are changed with respect to the samples having the composition of Sample No. 32.

As is apparent from FIG. 2, the life performances are excellent in both the cases of D.C. and A.C. when the $B_2O_3$ content is in the range of from 0.001 to 1.0 wt %. When it is less than 0.001 wt %, the deterioration of D.C. life performance becomes remarkable although that of A.C. life performance is kept in a small degree. When it exceeds 1 wt %, the deteriorations of both the D.C. and A.C. life performances become remarkable. The same tendency was seen also in the varistor of the system where the $Al^{3+}$ was not contained.

EXAMPLE 3

It is possible to obtain the same effects with the case of the $Al^{3+}$ addition by adding $In^{3+}$ or $Ga^{3+}$. Table 3 shows performances of varistors prepared by adding at least one components of $Al(NO_3)_3.9H_2O$, $In(NO_3)_3.3H_2O$ and $Ga(NO_3)_3.xH_2O$ according to the same procedures as in Example 2.

to the addition of $B_2O_3$, but also the improvement in the non-linearity. On the contrary, however, all the performances become determinated when the contents of $Al^{3+}$, $Ga^{3+}$ and $In^{3+}$ are too large.

EXAMPLE 4

ZnO, $Bi_2O_3$, $Co_2O_3$, MnO, $Sb_2O_3$, NiO, and at least one of $Al(NO_3)_3.9H_2O$, $In(NO_3)_3.H_2O$, $Ga(NO_3)_3.xH_2O$, and also $B_2O_3$ and at least one of $Ag_2O$ and $SiO_2$ were mixed and varistors having the compositon shown in Tables 4 and 4a were produced in the same manner as in Example 1. The performances thereof were aslo examined. Results are shown in Tables 4 and 4a. Also shown in the Tables are comparative examples for the varistors having the composition outside this invention. In Tables, the voltage-current non-linearity is indicated in terms of $V_{1\,kA}/V_{1\,mA}$ and the life performance in terms of $L_{200}$:

$$V_{1kA}/V_{1mA} = \frac{\text{V(voltage when a current of 1kA flows)}}{\text{V(voltage when a current of 1mA flows)}}$$

$$L_{200} = \frac{\text{V(after 200hr)} - \text{V(initial)}}{\text{V(initial)}} \times 100\%$$

TABLE 3

| Sample No. | ZnO (mol %) | $Bi_2O_3$ (mol %) | $Co_2O_3$ (mol %) | MnO (mol %) | $Sb_2O_3$ (mol %) | NiO (mol %) | $Al^{3+}$ (mol %) | $Ga^{3+}$ (mol %) | $In^{3+}$ (mol %) | $B_2O_3$ (wt %) | $V_{2kA}/V_{1mA}$ | A.C $L_{400}$ | D.C $L_{400}$ |
|---|---|---|---|---|---|---|---|---|---|---|---|---|---|
| Examples: | | | | | | | | | | | | | |
| 90 | Balance | 1.0 | 0.5 | 1.0 | 1.5 | 0.5 | 0.0001 | — | — | 0.1 | 1.95 | 0.79 | 1.30 |
| 91 | " | " | " | " | " | | 0.001 | — | — | " | 1.90 | 0.79 | 1.30 |
| 92 | " | " | " | " | " | " | 0.01 | — | — | " | 1.90 | 0.80 | 1.31 |
| 93 | " | " | " | " | " | " | 0.05 | — | — | " | 1.94 | 0.82 | 1.34 |
| 94 | " | " | " | " | " | " | — | 0.0001 | — | " | 1.95 | 0.80 | 1.30 |
| 95 | " | " | " | " | " | " | — | 0.001 | — | " | 1.90 | 0.80 | 1.30 |
| 96 | " | " | " | " | " | " | — | 0.01 | — | " | 1.90 | 0.81 | 1.31 |
| 97 | " | " | " | " | " | " | — | 0.05 | — | " | 1.94 | 0.82 | 1.34 |
| 98 | " | " | " | " | " | " | — | — | 0.0001 | " | 1.96 | 0.81 | 1.31 |
| 99 | " | " | " | " | " | " | — | — | 0.001 | " | 1.91 | 0.81 | 1.31 |
| 100 | " | " | " | " | " | " | — | — | 0.01 | " | 1.91 | 0.82 | 1.32 |
| 101 | " | " | " | " | " | " | — | — | 0.05 | " | 1.95 | 0.83 | 1.34 |
| 102 | " | " | " | " | " | " | 0.01 | 0.0001 | — | " | 1.90 | 0.80 | 1.31 |
| 103 | " | " | " | " | " | " | " | 0.001 | — | " | 1.90 | 0.81 | 1.31 |
| 104 | " | " | " | " | " | " | " | 0.01 | — | " | 1.92 | 0.82 | 1.32 |
| 105 | " | " | " | " | " | " | " | 0.05 | — | " | 1.95 | 0.83 | 1.33 |
| 106 | " | " | " | " | " | " | " | — | 0.0001 | " | 1.90 | 0.81 | 0.31 |
| 107 | " | " | " | " | " | " | " | — | 0.001 | " | 1.90 | 0.81 | 1.31 |
| 108 | " | " | " | " | " | " | " | — | 0.01 | " | 1.92 | 0.82 | 1.32 |
| 109 | " | " | " | " | " | " | " | — | 0.05 | " | 1.95 | 0.83 | 1.34 |
| 110 | " | " | " | " | " | " | — | 0.01 | 0.0001 | " | 1.90 | 0.81 | 1.31 |
| 111 | " | " | " | " | " | " | — | 0.01 | 0.001 | " | 1.90 | 0.82 | 1.32 |
| 112 | " | " | " | " | " | " | — | " | 0.01 | " | 1.92 | 0.83 | 1.33 |
| 113 | " | " | " | " | " | " | — | " | 0.05 | " | 1.96 | 0.84 | 1.34 |
| 114 | " | " | " | " | " | " | 0.001 | 0.001 | 0.001 | " | 1.90 | 0.81 | 1.31 |
| 115 | " | " | " | " | " | " | 0.01 | " | " | " | 1.90 | 0.82 | 1.31 |
| 116 | " | " | " | " | " | " | " | " | 0.01 | " | 1.92 | 0.82 | 1.32 |
| 117 | " | " | " | " | " | " | " | 0.07 | 0.01 | " | 1.94 | 0.83 | 1.33 |
| Comparative examples: | | | | | | | | | | | | | |
| 118 | " | " | " | " | " | " | 0.07 | — | — | " | 2.11 | X | X |
| 119 | " | " | | " | " | " | — | 0.07 | — | " | 2.12 | X | X |
| 120 | " | " | " | " | " | " | — | — | 0.07 | " | 2.12 | X | X |

As is apparent from Table 3, the system in which $B_2O_3$ is contained to the basic components comprising ZnO, $Bi_2O_3$, $CO_2O_3$, MnO, $Sb_3O_3$, NiO and at least one kind of $Al^{3+}$, $Ga^{3+}$ and $In^{3+}$, can be effective for not only the improvement in the life performance, particularly the direct current performance, which attributes wherein the voltage V (after 200 hours) is measured at room temperature after 95% of V1 mA has been continuously applied for 200 hours at temperature of 150° C.

The voltage in the above formula indicate sinusoidal peak voltage of 50 Hz when a current of 1 mA flows.

Mark X in the Tables indicates that the thermal runaway took place within 200 hours.

TABLE 4

| Sample No. | ZnO (mol %) | $Bi_2O_3$ (mol %) | $Co_2O_3$ (mol %) | MnO (mol %) | $Sb_2O_3$ (mol %) | NiO (mol %) | $Al^{3+}$ (mol %) | $B_2O_3$ (wt %) | $Ag_2O$ (wt %) | $SiO_2$ (wt %) | $V_{1kA}/V_{1mA}$ | A.C. $L_{200}$ (−) | D.C. $L_{200}$ (−) |
|---|---|---|---|---|---|---|---|---|---|---|---|---|---|
| Examples: | | | | | | | | | | | | | |
| 121 | Balance | 0.5 | 0.5 | 0.5 | 1.0 | 1.0 | 0.01 | 0.002 | — | — | 1.80 | 2.6 | 4.3 |
| 122 | " | " | " | " | " | " | " | 0.02 | — | — | 1.81 | 2.5 | 3.8 |
| 123 | " | " | " | " | " | " | " | 0.2 | — | — | 1.81 | 2.5 | 4.0 |
| 130 | " | " | " | " | " | " | " | 0.002 | 0.002 | — | 1.81 | 2.4 | 3.8 |
| 131 | " | " | " | " | " | " | " | " | 0.02 | — | 1.82 | 2.3 | 3.5 |
| 132 | " | " | " | " | " | " | " | " | 0.2 | — | 1.81 | 2.3 | 3.6 |
| 133 | " | " | " | " | " | " | " | 0.02 | 0.002 | — | 1.81 | 2.4 | 3.6 |
| 134 | " | " | " | " | " | " | " | " | 0.02 | — | 1.80 | 2.4 | 3.3 |
| 135 | " | " | " | " | " | " | " | " | 0.2 | — | 1.80 | 2.3 | 3.5 |
| 136 | " | " | " | " | " | " | " | 0.2 | 0.002 | — | 1.81 | 2.3 | 3.7 |
| 137 | " | " | " | " | " | " | " | " | 0.02 | — | 1.82 | 2.4 | 3.3 |
| 138 | " | " | " | " | " | " | " | " | 0.2 | — | 1.81 | 2.4 | 3.7 |
| 139 | " | " | " | " | " | " | " | 0.002 | — | 0.001 | 1.82 | 2.5 | 3.9 |
| 140 | " | " | " | " | " | " | " | " | — | 0.01 | 1.82 | 2.4 | 3.5 |
| 141 | " | " | " | " | " | " | " | " | — | 0.1 | 1.80 | 2.3 | 3.8 |
| 142 | " | " | " | " | " | " | " | 0.02 | — | 0.001 | 1.82 | 2.4 | 3.7 |
| 143 | " | " | " | " | " | " | " | " | — | 0.01 | 1.81 | 2.4 | 3.5 |
| 144 | " | " | " | " | " | " | " | " | — | 0.1 | 1.82 | 2.3 | 3.6 |
| 145 | " | " | " | " | " | " | " | 0.2 | — | 0.001 | 1.82 | 2.4 | 3.7 |
| 146 | " | " | " | " | " | " | " | " | — | 0.01 | 1.81 | 2.4 | 3.4 |
| 147 | " | " | " | " | " | " | " | " | — | 0.1 | 1.81 | 2.4 | 3.6 |
| 157 | " | " | " | " | " | " | " | 0.002 | 0.005 | 0.005 | 1.81 | 2.2 | 3.4 |
| 158 | " | " | " | " | " | " | " | 0.02 | " | " | 1.80 | 2.1 | 3.1 |
| 159 | " | " | " | " | " | " | " | 0.2 | " | " | 1.80 | 2.2 | 3.2 |
| 160 | " | " | " | " | " | " | " | 0.005 | 0.002 | " | 1.81 | 2.2 | 3.3 |
| 161 | " | " | " | " | " | " | " | " | 0.02 | " | 1.80 | 2.0 | 3.1 |
| 162 | " | " | " | " | " | " | " | " | 0.2 | " | 1.82 | 2.1 | 3.4 |
| 163 | " | " | " | " | " | " | " | " | 0.005 | 0.001 | 1.81 | 2.2 | 3.4 |
| 164 | " | " | " | " | " | " | " | " | " | 0.01 | 1.81 | 2.0 | 3.3 |
| 165 | " | " | " | " | " | " | " | " | " | 0.1 | 1.80 | 2.1 | 3.2 |
| 166 | " | 0.1 | " | " | " | " | " | 0.02 | 0.02 | 0.02 | 1.82 | 2.2 | 3.3 |
| 167 | " | 3.0 | " | " | " | " | " | " | " | " | 1.82 | 2.0 | 3.0 |
| 168 | " | 5.0 | " | " | " | " | " | " | " | " | 1.82 | 2.1 | 3.2 |
| 169 | " | 0.5 | 0.1 | " | " | " | " | " | " | " | 1.81 | 2.1 | 3.2 |
| 170 | " | " | 3.0 | " | " | " | " | " | " | " | 1.81 | 2.0 | 3.0 |
| 171 | " | " | 5.0 | " | " | " | " | " | " | " | 1.81 | 2.2 | 3.1 |
| 172 | " | " | 0.5 | 0.1 | " | " | " | " | " | " | 1.80 | 2.2 | 3.2 |
| 173 | " | " | " | 3.0 | " | " | " | " | " | " | 1.80 | 2.1 | 3.1 |
| 174 | " | " | " | 5.0 | " | " | " | " | " | " | 1.80 | 2.1 | 3.3 |
| 175 | " | " | " | 0.5 | 0.1 | " | " | " | " | " | 1.81 | 2.2 | 3.2 |
| 176 | " | " | " | " | 3.0 | " | " | " | " | " | 1.81 | 2.0 | 3.0 |
| 177 | " | " | " | " | 5.0 | " | " | " | " | " | 1.82 | 2.1 | 3.2 |
| 178 | " | " | " | " | 1.0 | 0.1 | " | " | " | " | 1.82 | 2.2 | 3.3 |
| 179 | " | " | " | " | " | 3.0 | " | " | " | " | 1.81 | 2.1 | 3.0 |
| 180 | " | " | " | " | " | 5.0 | " | " | " | " | 1.80 | 2.0 | 3.2 |
| 181 | " | " | " | " | " | 1.0 | 0.001 | " | " | " | 1.81 | 2.1 | 3.1 |
| 182 | " | " | " | " | " | " | 0.03 | " | " | " | 1.81 | 2.2 | 3.3 |
| 183 | " | " | " | " | " | " | 0.05 | " | " | " | 1.82 | 2.0 | 3.3 |
| 184 | " | 0.1 | 0.1 | 3.0 | 3.0 | 3.0 | 0.03 | " | " | 0.001 | 1.81 | 2.1 | 3.0 |
| 185 | " | " | " | " | " | " | " | 0.2 | " | 0.01 | 1.80 | 2.0 | 3.3 |
| 186 | " | " | " | " | " | " | " | 0.02 | 0.2 | " | 1.81 | 2.2 | 3.0 |
| 187 | " | 3.0 | 3.0 | 0.1 | 0.1 | " | " | 0.2 | 0.02 | 0.001 | 1.82 | 2.1 | 3.4 |
| 188 | " | " | " | " | " | " | " | 0.02 | " | 0.01 | 1.81 | 2.2 | 3.0 |
| 189 | " | " | " | " | " | " | " | " | 0.2 | " | 1.81 | 2.0 | 3.4 |
| 190 | " | " | " | 5.0 | " | 5.0 | 0.05 | 0.002 | 0.02 | 0.1 | 1.80 | 2.1 | 3.3 |
| 191 | " | " | " | " | " | " | " | " | " | 0.01 | 1.81 | 2.1 | 3.3 |
| 192 | " | " | " | " | " | " | " | 0.2 | 0.2 | 0.001 | 1.81 | 2.0 | 3.5 |
| Comparative examples | | | | | | | | | | | | | |
| 205 | " | 0.5 | 0.5 | 0.5 | 1.0 | 1.0 | 0.01 | 3.0 | — | — | 2.12 | 7.6 | X |
| 206 | " | " | " | " | " | " | " | 0.02 | 0.5 | — | 2.51 | X | X |
| 207 | " | " | " | " | " | " | " | " | — | 0.5 | 2.41 | X | X |

TABLE 4a

| Sample No. | ZnO | $Bi_2O_3$ | $Co_2O_3$ (mol %) | MnO | $Sb_2O_3$ | NiO | $Al^{3+}$ (mol %) | $Ga^{3+}$ (mol %) | $In^{3+}$ (mol %) | $B_2O_3$ (wt %) | $Ag_2O$ (wt %) | $SiO_2$ (wt %) | $V_{1kA}/V_{1mA}$ | A.C. $L_{200}$ (−) | D.C. $L_{200}$ (−) |
|---|---|---|---|---|---|---|---|---|---|---|---|---|---|---|---|
| Examples: | | | | | | | | | | | | | | | |
| 208 | Bal. | 0.5 | 0.5 | 0.5 | 1.0 | 1.0 | — | 0.0001 | — | 0.02 | 0.02 | 0.02 | 1.86 | 2.9 | 3.7 |
| 209 | " | " | " | " | " | " | — | 0.001 | — | " | " | " | 1.81 | 2.5 | 3.2 |
| 210 | " | " | " | " | " | " | — | 0.03 | — | " | " | " | 1.81 | 2.4 | 3.3 |
| 211 | " | " | " | " | " | " | — | 0.05 | — | " | " | " | 1.82 | 2.3 | 3.4 |
| 212 | " | " | " | " | " | " | — | — | 0.0001 | " | " | " | 1.86 | 2.6 | 3.7 |
| 213 | " | " | " | " | " | " | — | — | 0.001 | " | " | " | 1.81 | 2.1 | 3.2 |
| 214 | " | " | " | " | " | " | — | — | 0.03 | " | " | " | 1.81 | 2.1 | 3.3 |
| 215 | " | " | " | " | " | " | — | — | 0.05 | " | " | " | 1.83 | 2.0 | 3.4 |
| 216 | " | " | " | " | " | " | — | 0.01 | — | " | 0.002 | — | 1.81 | 2.6 | 3.9 |
| 217 | " | " | " | " | " | " | — | " | — | " | 0.02 | — | 1.81 | 2.5 | 3.6 |
| 218 | " | " | " | " | " | " | — | " | — | " | 0.2 | — | 1.83 | 2.6 | 3.8 |
| 219 | " | " | " | " | " | " | — | — | 0.01 | " | — | 0.002 | 1.82 | 2.6 | 4.0 |
| 220 | " | " | " | " | " | " | — | — | " | " | — | 0.02 | 1.81 | 2.5 | 3.8 |
| 221 | " | " | " | " | " | " | — | — | " | " | — | 0.2 | 1.81 | 2.5 | 3.6 |
| 222 | " | " | " | " | " | " | — | 0.01 | — | " | — | 0.002 | 1.82 | 2.6 | 4.0 |
| 223 | " | " | " | " | " | " | — | " | — | " | — | 0.02 | 1.81 | 2.5 | 3.8 |
| 224 | " | " | " | " | " | " | — | " | — | " | — | 0.2 | 1.81 | 2.5 | 3.6 |
| 225 | " | " | " | " | " | " | — | — | 0.01 | " | 0.002 | — | 1.81 | 2.6 | 3.9 |
| 226 | " | " | " | " | " | " | — | — | " | " | 0.02 | — | 1.81 | 2.5 | 3.6 |
| 227 | " | " | " | " | " | " | — | — | " | " | 0.2 | — | 1.83 | 2.6 | 3.8 |
| 228 | " | " | " | " | " | " | 0.01 | 0.01 | — | " | 0.02 | 0.02 | 1.81 | 2.1 | 3.0 |
| 229 | " | " | " | " | " | " | " | — | 0.01 | " | " | " | 1.81 | 2.1 | 3.0 |
| 230 | " | " | " | " | " | " | " | 0.01 | " | " | " | " | 1.81 | 2.1 | 3.0 |

As is seen from Table 4, Sample Nos. 121 to 192 which are examples of this invention show that both the non-linearity ($V_{1\ kA}/V_{1\ mA}$) and the life performance ($L_{200}$) thereof are superior to those of Sample Nos. 205 to 207 which are comparative examples.

Sample Nos. 121 to 123 contain $B_2O_3$ and neither $Ag_2O$ nor $SiO_2$; Sample Nos. 130 to 147 $B_2O_3$ and either $Ag_2O$ or $SiO_2$; Sample Nos. 157 to 192 $B_2O_3$ and both $Ag_2O$ and $SiO_2$. It can be seen from these examples that the more kinds of these components are added, the better the life performance is improved. However, as will be seen from Sample Nos. 205 and 207 which are comparative examples, the improvement of the life performance is not effective and moreover even the non-linearity is impaired when the contents of these components are excessive.

Sample Nos. 208 to 227 shown in Table 4a contain at least one of $Al^{3+}$, Ga3+ and $In^{3+}$, from which it is seen that the life performance is also improved.

EXAMPLE 5

ZnO, $Bi_2O_3$, $Co_2O_3$, MnO, $Sb_2O_3$, NiO, $Al(NO_3)_3.9H_2O$ and B-containing glass were mixed and varistors having the composition shown in Table 5 were produced in the same procedures as in Example 1. The performances thereof were also examined in the same manner as in Example 1. Results are shown in Table 5. Also shown in Table 5 are comparative examples for the varistors having the composition outside this invention. In Table 5, the voltage current non-linearity is indicated in terms of $V_{2\ kA}/V_{1\ mA}$ and the life performance in terms of $L_{400}$.

In Table 5, mark X indicates that the thermal runaway took place in 400 hours; symbols A to H denotes the glass as indentified below:

A: $Ag_2O$—$B_2O_3$—$SiO_2$—$Bi_2O_3$ glass
B: $B_2O_3$—$SiO_2$—$Bi_2O_3$ glass
C: ZnO—$B_2O_3$—$SiO_2$ glass
D: PbO—$B_2O_3$—$Bi_2O_3$ glass
E: PbO—$B_2O_3$ glass
F: ZnO—$B_2O_3$—$V_2O_5$ glass
G: ZnO—$B_2O_3$—$V_2O_5$—$SiO_2$ glass
H: $B_2O_3$—$SiO_2$—BaO—MgO—$Al_2O_3$ glass.

TABLE 5

| Sample No. | ZnO | $Bi_2O_3$ | $Co_2O_3$ (mol %) | MnO | $Sb_2O_3$ | NiO | $Al^{3+}$ (mol %) | B-containing glass Kind (wt %) | B-containing glass $B_2O_3$ (wt %) | $V_{2kA}/V_{1mA}$ | A.C $L_{400}$ | D.C $L_{400}$ |
|---|---|---|---|---|---|---|---|---|---|---|---|---|
| Examples: | | | | | | | | | | | | |
| 301 | Bal. | 0.1 | 0.5 | 1.0 | 1.0 | 1.0 | 0.01 | A 0.1 | 0.02 | 1.97 | 1.30 | 2.25 |
| 302 | " | 3.0 | " | " | " | " | " | A 0.1 | " | 1.94 | 1.11 | 2.11 |
| 303 | " | 5.0 | " | " | " | " | " | A 0.1 | " | 1.95 | 1.31 | 2.31 |
| 304 | " | " | 0.1 | " | " | " | " | A 0.1 | " | 1.98 | 1.41 | 2.31 |
| 305 | " | " | 3.0 | " | " | " | " | A 0.1 | " | 1.95 | 1.15 | 2.12 |
| 306 | " | " | 5.0 | " | " | " | " | A 0.1 | " | 1.98 | 1.43 | 2.43 |
| 307 | " | " | 0.5 | 0.1 | " | " | " | A 0.1 | " | 1.98 | 1.41 | 2.41 |
| 308 | " | " | " | 3.0 | " | " | " | A 0.1 | " | 1.94 | 1.18 | 2.13 |
| 309 | " | " | " | 5.0 | " | " | " | A 0.1 | " | 1.97 | 1.51 | 2.50 |
| 310 | " | " | " | 1.0 | 0.1 | " | " | A 0.1 | " | 1.98 | 1.31 | 2.38 |
| 311 | " | " | " | " | 3.0 | " | " | A 0.1 | " | 1.95 | 1.14 | 2.11 |
| 312 | " | " | " | " | 5.0 | " | " | A 0.1 | " | 1.97 | 1.42 | 2.45 |
| 313 | " | " | " | " | 1.0 | 0.1 | " | A 0.1 | " | 1.98 | 1.39 | 2.39 |
| 314 | " | " | " | " | " | 3.0 | " | A 0.1 | " | 1.94 | 1.12 | 2.11 |
| 315 | " | " | " | " | " | 5.0 | " | A 0.1 | " | 1.98 | 1.45 | 2.41 |
| 316 | " | 0.5 | " | " | " | 1.0 | 0.0001 | A 0.1 | " | 1.98 | 1.10 | 2.10 |

TABLE 5-continued

| Sample No. | ZnO | $Bi_2O_3$ | $Co_2O_3$ | MnO | $Sb_2O_3$ | NiO | $Al^{3+}$ | B-containing glass | | | A.C | D.C |
|---|---|---|---|---|---|---|---|---|---|---|---|---|
| | (mol %) | | | | | | (mol %) | Kind (wt %) | $B_2O_3$ (wt %) | $V_{2kA}/V_{1mA}$ | $L_{400}$ | $L_{400}$ |
| 317 | " | " | " | " | " | " | 0.001 | A 0.1 | " | 1.93 | 1.10 | 2.10 |
| 318 | " | " | " | " | " | " | 0.01 | A 0.1 | " | 1.93 | 1.11 | 2.12 |
| 319 | " | " | " | " | " | " | 0.05 | A 0.1 | " | 1.97 | 1.12 | 2.15 |
| 320 | " | " | " | " | " | " | 0.01 | A 0.005 | 0.001 | 1.92 | 1.41 | 2.48 |
| 321 | " | " | " | " | " | " | " | A 0.05 | 0.01 | 1.92 | 1.10 | 2.10 |
| 322 | " | " | " | " | " | " | " | A 0.5 | 0.1 | 1.95 | 1.10 | 2.10 |
| 323 | " | " | " | " | " | " | " | A 5.0 | 1.0 | 1.99 | 1.45 | 2.50 |
| 324 | " | " | " | " | " | " | " | B 0.05 | 0.01 | 1.93 | 1.10 | 2.10 |
| 325 | " | " | " | " | " | " | " | B 0.25 | 0.05 | 1.95 | 1.10 | 2.10 |
| 326 | " | " | " | " | " | " | " | C 0.02 | 0.01 | 1.92 | 1.10 | 2.10 |
| 327 | " | " | " | " | " | " | " | C 0.1 | 0.05 | 1.94 | 1.10 | 2.10 |
| 328 | " | " | " | " | " | " | " | D 0.1 | 0.01 | 1.98 | 1.16 | 2.16 |
| 329 | " | " | " | " | " | " | " | D 0.5 | 0.05 | 2.00 | 1.16 | 2.16 |
| 330 | " | " | " | " | " | " | " | E 0.1 | 0.01 | 1.98 | 1.16 | 2.16 |
| 331 | " | " | " | " | " | " | " | E 0.5 | 0.05 | 2.00 | 1.16 | 2.16 |
| 332 | " | " | " | " | " | " | " | F 0.05 | 0.015 | 1.93 | 1.17 | 2.17 |
| 333 | " | " | " | " | " | " | " | F 0.15 | 0.045 | 1.95 | 1.17 | 2.17 |
| 334 | " | " | " | " | " | " | " | G 0.05 | 0.015 | 1.93 | 1.17 | 2.17 |
| 335 | " | " | " | " | " | " | " | G 0.15 | 0.045 | 1.95 | 1.17 | 2.17 |
| 336 | " | " | " | " | " | " | " | H 0.025 | 0.01 | 1.93 | 1.16 | 2.16 |
| 337 | " | " | " | " | " | " | " | H 0.01 | 0.04 | 1.93 | 1.16 | 2.16 |
| Comparative examples: | | | | | | | | | | | | |
| 338 | " | " | " | " | " | " | " | A 0.0025 | 0.0005 | 1.91 | 1.44 | X |
| 339 | " | " | " | " | " | " | " | A 20.0 | 4.0 | 2.45 | X | X |
| 340 | " | " | " | " | " | " | — | A 5.0 | 1.0 | 2.25 | 1.46 | 2.53 |
| 341 | " | " | " | " | " | " | 0.1 | A 0.1 | 0.02 | 2.35 | X | X |

As is apparent from Table 5, examples of this invention show smaller D.C. $L_{400}$ value as being excellent in the direct life performance. It is also apparent therefrom that other performances such as the alternating current life performance (A.C. $L_{400}$) and non-liniarity ($V_{2\,kA}/V_{1\,mA}$) are also excellent.

As is seen from comparative examples of Sample Nos. 338 and 339, the D.C. life performance become inferior when the content of glass is too small, and when it is too large not only the D.C life performance but also the A.C. life performance and the non-linearity become inferior.

As is also seen from comparative examples of Sample Nos. 340 and 341, even when the glass were contained in the desired amount, the non-linearity becomes remarkably inferior if the content of Al is outside the range of this invention. In particular, when the Al is not contained, the heat runaway takes place in both the cases of A.C. and D.C. When the Al content is too small, the life performance becomes inferior although not so remarkable as in the case of a large Al content.

When the content of Al is outside the range of this invention, there is remarkable lowering of energy dissipation capability. Table 6 shows the energy dissipation capability of varistors having the composition of Sample No. 316 with varied content of Al. Similarly, FIG. 3 shows a characteristic curve for the energy dissipation capability.

Figure 3:
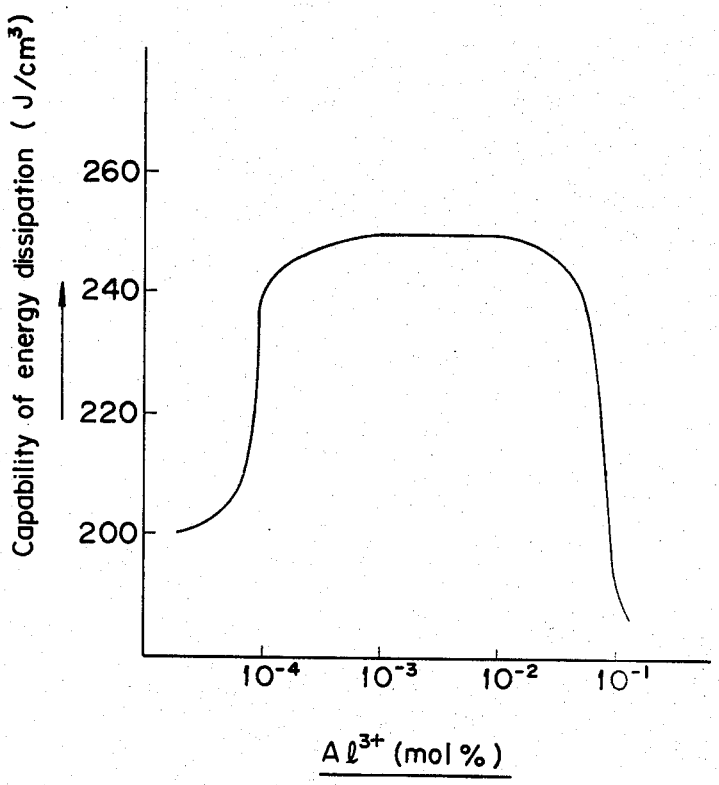

As will be seen from Table 6 and FIG. 3, the energy dissipation capability is around 250 J/cm$^3$ when the Al content is inside the invention, but it is 200 J/cm$^3$ or lower when the content is outside the invention.

Substantially the same results as shown in FIG. 3 were obtained in the varristors reported in Examples 2, 3 and 4 where B was added not in the form of the B-containing glass.

TABLE 6

| $Al^{3+}$ content (mol %) | Energy dissipation capability (J/cm$^3$) |
|---|---|
| 0 | 200 |
| $10^{-4}$ | 240 |
| $10^{-3}$ | 250 |
| $10^{-2}$ | 240 |
| $5 \times 10^{-2}$ | 240 |
| $10^{-1}$ | 190 |

EXAMPLE 6

The same effects were obtainable when at least one of the $Al^{3+}$, $In^{3+}$ and $Ga^{3+}$ were used and tested in the same manner as in Example 5. Results are shown in Table 7.

TABLE 7

| Sample No. | ZnO | $Bi_2O_3$ | $Co_2O_3$ | MnO | $Sb_2O_3$ | NiO | $Al^{3+}$ | $In^{3+}$ | $Ga^{3+}$ | B-containing glass | | | A.C | D.C |
|---|---|---|---|---|---|---|---|---|---|---|---|---|---|---|
| | (mol %) | | | | | | | (mol %) | | Kind (wt %) | $B_2O_3$ (wt %) | $V_{2kA}/V_{1mA}$ | $L_{400}$ | $L_{400}$ |
| Examples: | | | | | | | | | | | | | | |
| 342 | Bal. | 0.5 | 0.5 | 1.0 | 1.0 | 1.0 | — | 0.01 | — | A 0.1 | 0.02 | 1.93 | 1.12 | 2.13 |
| 343 | " | " | " | " | " | " | — | — | 0.01 | " | " | 1.93 | 1.13 | 2.14 |
| 344 | " | " | " | " | " | " | 0.01 | 0.001 | — | " | " | 1.93 | 1.12 | 2.13 |
| 345 | " | " | " | " | " | " | 0.01 | — | 0.001 | " | " | 1.93 | 1.13 | 2.14 |
| 346 | " | " | " | " | " | " | — | 0.01 | 0.001 | " | " | 1.93 | 1.13 | 2.14 |
| 347 | " | " | " | " | " | " | — | 0.001 | 0.01 | " | " | 1.93 | 1.13 | 2.14 |
| 348 | " | " | " | " | " | " | 0.01 | 0.001 | 0.001 | " | " | 1.93 | 1.13 | 2.14 |

As is apparent from Table 7, the employment of In and Ga gives the same effect as in the employment of Al. Thus, the varistors having, in particular, excellent D.C. life performance can be obtained by the addition of the B-containing glass.

EXAMPLE 7

Figure 4:
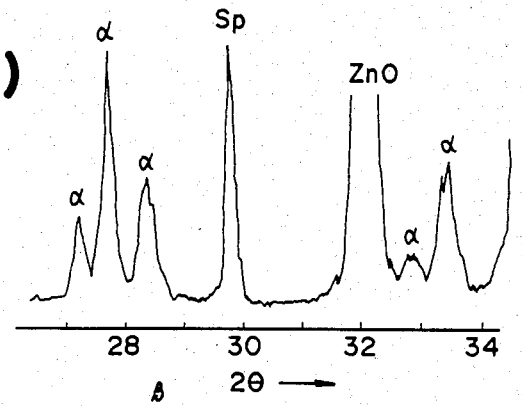
FIGS. 4(*a*) to 4(*d*) are X-ray diffraction patterns identifying crystal structures.
Figure 4:
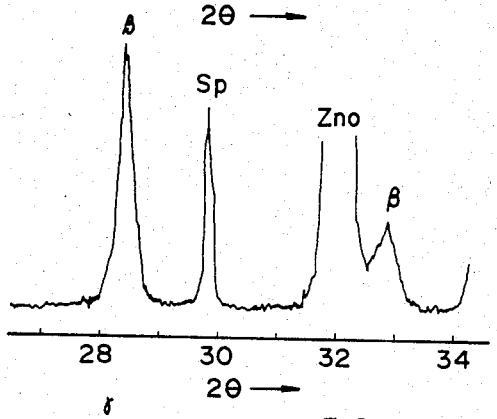
Figure 4:
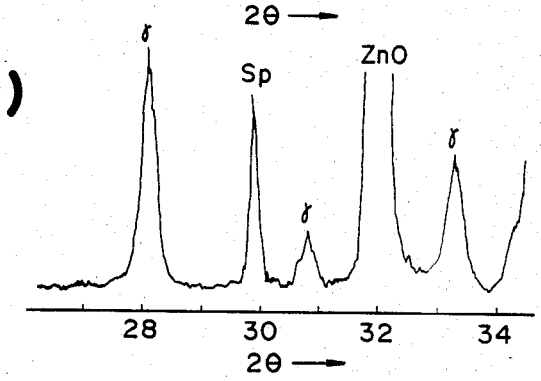
Figure 4:
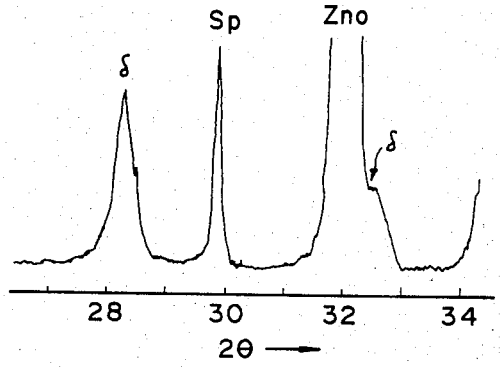

$Bi_2O_3$ phases in the sintered body were further examined. $Bi_2O_3$ can exist in the sintered body by assuming various phases such as α-phase (orthorhombic lattice), β-phase (tetragonal lattice), γ-phase (body-centered cubic structure) and δ-phase (face-centered cubic structure), whose interplanar spacings are similar to each other. The proportion of these phases varies depending on the composition of the sintered body and the conditions for the production of the same. Moreover, it is difficult to identify the crystal phase because a solid solution is formed with the additives such as Sb, Mn, Co, Ni, B, Si, Ag and so on whereby the crystal lattice are distorted. To give a reference, FIGS. 4(*a*) to 4(*d*) show X-ray diffraction patterns of the α-phase, β-phase, γ-phase and δ-phase, respectively, when CuKα radiation was used. Although the peak positions deviate from those shown in the ASTM (American Society for Testing Materials) Powder Diffraction Data File, depending on the kinds and contents of the additives, there can be recognized characteristic profiles wherein the α-phase has three peaks at around $2\theta=27°$ to 29° and the γ-phase a small peak at around $2\theta=31°$. These facts or data were taken into account to identify the crystal phase.

Figure 5:
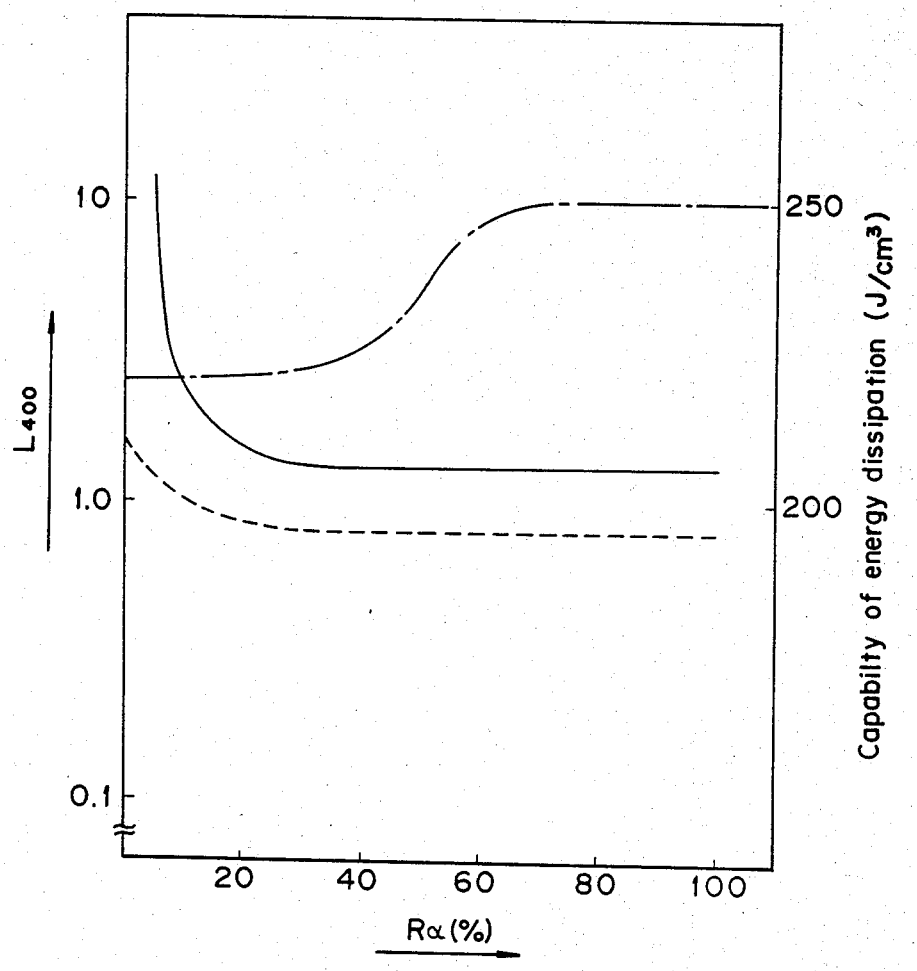

FIG. 5 shows the relationship between the amount of α-phase and the life performance of the varistors produced in the same procedures as in the foregoing and by use of materials having the composition comprising ZnO as a principal component and, as auxiliary components, 0.1 to 5 mol % each of $Bi_2O_3$, $CO_2O_3$, MnO, $Sb_2O_3$ and NiO, and 0.0001 to 0.05 mol % of $Al(NO_3)_3.9H_2O$ when calculated in terms of $Al^{3+}$, to which added was 0 to 1.0 wt % of $H_3BO_3$ when calculated in terms of $B_2O_3$. In FIG. 5, solid line designates the direct current life performance and dotted line the alternating current life performance.

The amount of α-phase was determined by Rα shown below:

$$R\alpha = \frac{I(\alpha)}{I(\alpha) + I(\beta) + I(\gamma) + I(\delta)} \times 100$$

wherein;
$I(\alpha)$: Maximum intensity by X-ray diffraction
$I(\beta)$: Maximum intensity by X-ray diffraction
$I(\gamma)$: Maximum intensity by X-ray diffraction
$I(\delta)$: Maximum intensity by X-ray diffraction As is seen from FIG. 5, the life performances in both the direct current and the alternating current are improved as the value Rα becomes larger.

In particular, when a direct current is applied, $L_{400}$ is improved at $R\alpha \geqq 10$ and it becomes substantially constant at $R\alpha \geqq 30$. When Rα is too small, the thermal runaway takes place in the case of D.C. application. $R\alpha=0$, when no B is added. The α-phase begins to exist as the B is added. From a view point of the content of B, the Rα becomes almost 100 when it is in the range of 0.02 to 0.1 wt % being calculated in terms of $B_2O_3$, which is a preferable range.

The α-phase of $Bi_2O_3$ becomes present by the addition of a trace amount of B as mentioned above, but the $Bi_2O_3$ becomes amorphous if B is contained in a too large amount.

A.C. $L_{400}$ is also improved, though not so remarkably as in D.C. $L_{400}$, as the α-phase increases, particularly when $R\alpha \geqq 30$.

Thus, the varistors having very good life performance can be obtained when $R\alpha \geqq 10$, especially when $R\alpha \geqq 30$. The same tendency was seen also in the varistor of the system where $Al^{3+}$ was not contained.

Furthermore, as also shown in FIG. 5 by chain line, the energy dissipation capability can be improved at around $R\alpha \geqq 50$, in particular, it becomes stable in a desired state at around $R\alpha \geqq 60$.

Table 8 shows Rα (%) of the samples having various composition of B. The sample numbers correspond to the examples and the comparative examples described in the foregoing. A.C. $L_{400}$ and D.C. $L_{400}$ also designate the same values mentioned in the foregoing.

TABLE 8

| Sample No. | Rα (%) | A.C $L_{400}$ | D.C $L_{400}$ |
|---|---|---|---|
| 32 | 10 | 0.91 | 1.58 |
| 33 | 75 | 0.80 | 1.31 |
| 34 | 100 | 0.80 | 1.31 |
| 35 | 100 | 0.88 | 1.50 |
| 36 | 0 | 1.05 | X |
| 62 | 10 | 0.87 | 1.50 |
| 63 | 75 | 0.79 | 1.29 |
| 64 | 100 | 0.79 | 1.29 |
| 65 | 100 | 0.87 | 1.49 |
| 66 | 0 | 1.05 | X |

As is seen from Table 8, excellent performances are obtained when Rα is not less than 10%. No α-phase is produced in Sample Nos. 36 and 66 which are comparative examples.

We claim:

1. A varistor comprising a sintered body which consists essentially of:

a basic component consisting essentially of zinc oxide as a principal constituent and, as auxiliary constituents, bismuth, cobalt, manganese, antimony and nickel in an amount, when calculated in terms of $Bi_2O_3$, $Co_2O_3$, MnO, $Sb_2O_3$ and NiO, respectively, of $Bi_2O_3$: 0.1 to 5 mol %, $Co_2O_3$: 0.1 to 5 mol %, MnO: 0.1 to 5 mol %, $Sb_2O_3$: 0.1 to 5 mol % and NiO: 0.1 to 5 mol %; and an additional component comprising boron in an amount, when calculated in terms of $B_2O_3$, of 0.001 to 1 wt % based on said basic component, said $Bi_2O_3$ comprising not less than 30% of α-phase, said sintered body being substantially free of chromium.

2. The varistor according to claim 1, wherein said basic component further comprises at least one selected from the group consisting of aluminum, indium and gallium in an amount, when calculated in terms of $Al^{3+}$, $In^{3+}$ and $Ga^{3+}$, respectively, of from 0.0001 to 0.05 mol %; and said additional component comprising the boron.

3. The varistor according to claim 2, wherein said additional component further comprises at least one selected from the group consisting of silver and silicon in an amount, when calculated in terms of $Ag_2O$ and $SiO_2$, of from 0.002 to 0.2 wt % and 0.001 to 0.1 wt %, respectively, based on said basic component.

4. The varistor according to claim 2, wherein said additional component is a glass containing boron in an amount, when calculated in terms of $B_2O_3$, of from 0.001 to 1 wt % based on said basic component.

5. The varistor according to claim 3, wherein said boron is present in an amount, when calculated in terms of $B_2O_3$, of from 0.002 to 0.2 wt % based on said basic component.

6. The varistor according to claim 1, wherein said boron is present in the form of at least one selected from the group consisting of $B_2O_3$, $H_3BO_3$, $HBO_2$, $B_2(OH)_4$, $ZnB_4O_7$, $AgBO_2$, ammonium borate, $Ag_2B_4O_7$, $BaB_4O_7$, $Mg(BO_2)_2.8H_2O$, $MnB_4O_7.8H_2O$, $BiBO_3$, $Ni_3(BO_3)_2$ and $Ni_2B_2O_5$.

7. The varistor according to claim 2, wherein said boron is present in the form of at least one selected from the group consisting of $B_2O_3$, $H_3BO_3$, $HBO_2$, $B_2(OH)_4$, $ZnB_4O_7$, $AgBO_2$, ammonium borate, $Ag_2B_4O_7$, $BaB_4O_7$, $Mg(BO_2)_2.8H_2O$, $MnB_4O_7.8H_2O$, $BiBO_3$, $Ni_3(BO_3)_2$ and $Ni_2B_2O_5$.

8. The varistor according to claim 2, wherein each of said aluminum, said indium and said gallium is present in the form of $Al(NO_3)_3.9H_2O$, $In(NO_3)_3.9H_2O$ and $Ga(NO_3)_3.xH_2O$, respectively.

9. The varistor according to claim 4, wherein said glass containing boron is selected from the group consisting of $Ag_2O—B_2O_3—SiO_2—Bi_2O_3$ glass, $B_2O_3—SiO_2—Bi_2O_3$ glass, $ZnO—B_2O_3—SiO_2$ glass, $PbO—B_2O_3—Bi_2O_3$ glass, $PbO—B_2O_3$ glass, $ZnO—B_2O_3—V_2O_5$ glass, $ZnO—B_2O_3—V_2O_5—SiO_2$ glass and $B_2O_3—SiO_2—BaO—MgO—Al_2O_3$ glass.

10. The varistor according to claim 1, wherein said $\alpha$-phase is not less than 50%.

11. The varistor according to claim 1, wherein said $\alpha$-phase is substantially 100%.

12. The varistor according to claim 1, wherein said sintered body is the product of a process consisting essentially of the steps of (a) preparing a homogeneous mixture comprising said principal constituent and said auxiliary constituents and (b) sintering said mixture.

* * * * *